US006578591B1

(12) United States Patent
Eksert et al.

(10) Patent No.: US 6,578,591 B1
(45) Date of Patent: Jun. 17, 2003

(54) DISHWASHER WITH IMPROVED DRYING PERFORMANCE

(76) Inventors: Semsettin Eksert, Arçelik A.S., E5 Ankara Asfalti Üzeri, Istanbul 81719 (TR); Gökhan Özgürel, Arçelik A.S., E5 Ankara Asfalti Üzeri, Tuzla, Istanbul 81719 (TR); Ufuk Askin, Arçelik A.S., E5 Ankara Asflati Üzeri Tuzla, Istanbul 81719 (TR)

( * ) Notice: Subject to any disclaimer, the term of this patent is extended or adjusted under 35 U.S.C. 154(b) by 0 days.

(21) Appl. No.: 09/719,307

(22) PCT Filed: Feb. 8, 1999

(86) PCT No.: PCT/TR99/00009

§ 371 (c)(1),
(2), (4) Date: Jun. 4, 2000

(87) PCT Pub. No.: WO99/63880

PCT Pub. Date: Dec. 16, 1999

(30) Foreign Application Priority Data

Jun. 9, 1998 (TR) ..... 98/1061

(51) Int. Cl.[7] ..... A47L 15/48

(52) U.S. Cl. ..... 134/107; 34/77; 34/235; 134/95.2

(58) Field of Search ..... 134/95.2, 107; 68/20; 34/76, 77, 235

(56) References Cited

U.S. PATENT DOCUMENTS 4,709,488 A 12/1987 Anselmino et al.
5,355,900 A * 10/1994 Sakata ..... 134/95.2

FOREIGN PATENT DOCUMENTS

GB 1245570 A 9/1971

* cited by examiner

*Primary Examiner*—Philip R. Coe
(74) *Attorney, Agent, or Firm*—Nixon & Vanderhye

(57) ABSTRACT

The present invention relates to a dishwasher with enhanced drying performance without using a fan. Water contained in the dishwasher is circulated preferably by means of one of the pumps in the machine (circulation or discharge pump) and through a jet pump placed in the dishwasher in such a manner that the air intake opening is in communication with one of the wash tub surfaces. Water within the dishwasher accelerates due to the kinetic energy acquired during this circulation and its pressure drops locally to a value below the atmospheric pressure. Due to this reduced pressure, water vapour and air from the washtub is suctioned from the tub.

19 Claims, 6 Drawing Sheets

DISHWASHER WITH IMPROVED DRYING PERFORMANCE

The present invention relates to a dishwasher developed in order to improve the drying performance obtained after washing.

It is well-known that discharging the water vapour remained in the machine after the washing cycle is completed or condensing it by means of a special device at a different point, improves the performance concerning drying effectiveness in dishwashers. Until now, various ways of improving drying performance in dishwashers have been tried. The systems utilized provide the improvement of drying performance either by natural convection method or by means of a fan.

In natural convection method, water vapour formed in the machine body after washing, is intended to be discharged by means of a vent opened on the machine body. All studies made on this method are directed towards increasing the efficiency of the natural convection by modifying the geometric shape or location of the said vent.

The development of the systems providing coercive (forced) ventilation has been in the direction of inhaling vapour from inside by means of a fan. Embodiments of systems with fan, for instance those disclosed in the patent applications EP 93102395, EP 92710019 or EP 96100564 solve the problem of water vapour inhalation by different geometrical or functional methods, however all of them incorporate a fan for sucking the vapour or moist air. The only and primary fluid used in fan-systems is air.

In other words, a fan realizes the removal of vapour and air by inhalation, by means of a rotational movement created by its fan motor.

The object of the present invention is to improve the drying performance of dishwashers by means of a jet pump, without using fan, more economically than that provided by fan applications and more effectively and more efficiently than that provided by natural convection method.

The dishwasher with improved drying performance of the invention realized to achieve this object is shown schematically in the attached drawings, wherein.

Figure 2:
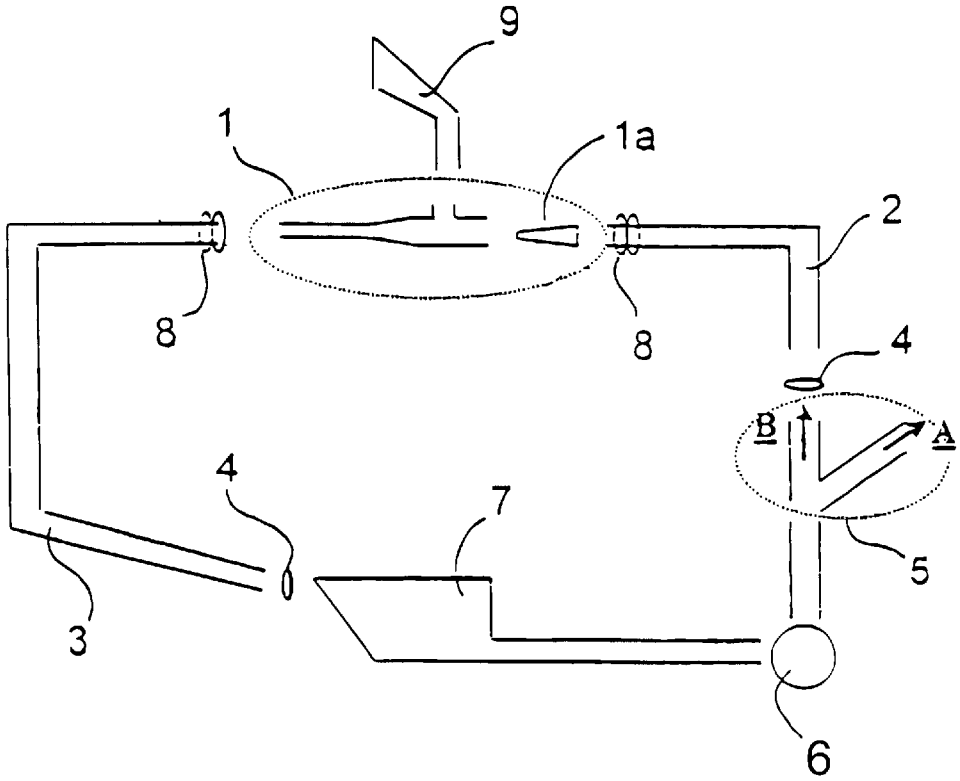
FIG. 2, is a schematic view of the jet pump application using a circulation pump.
Figure 2A:
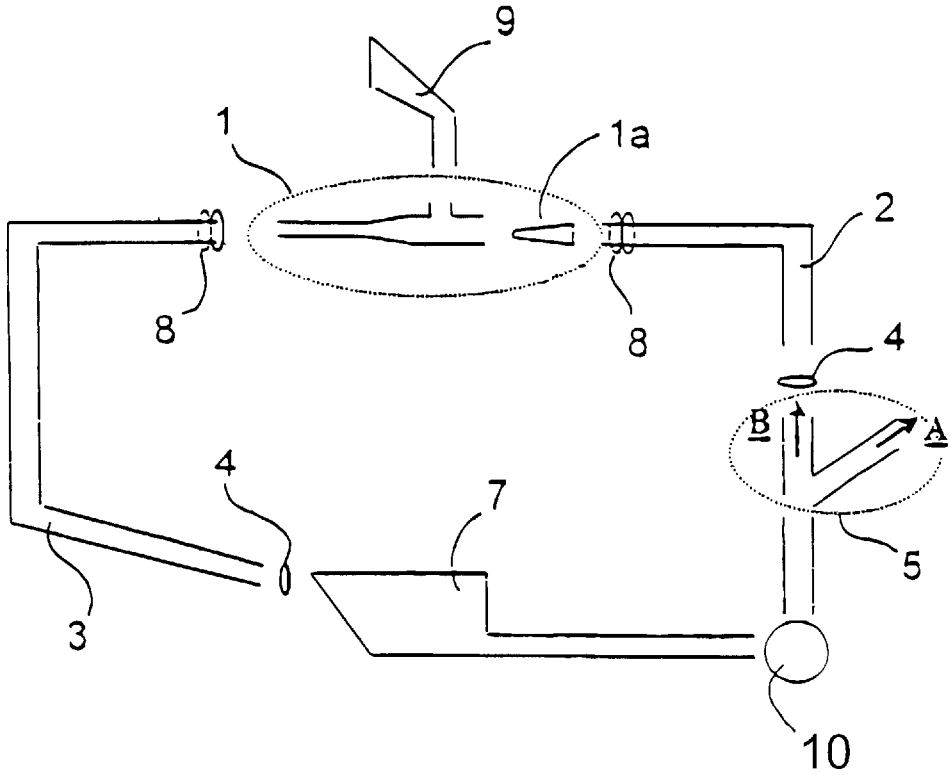
Figure 3:
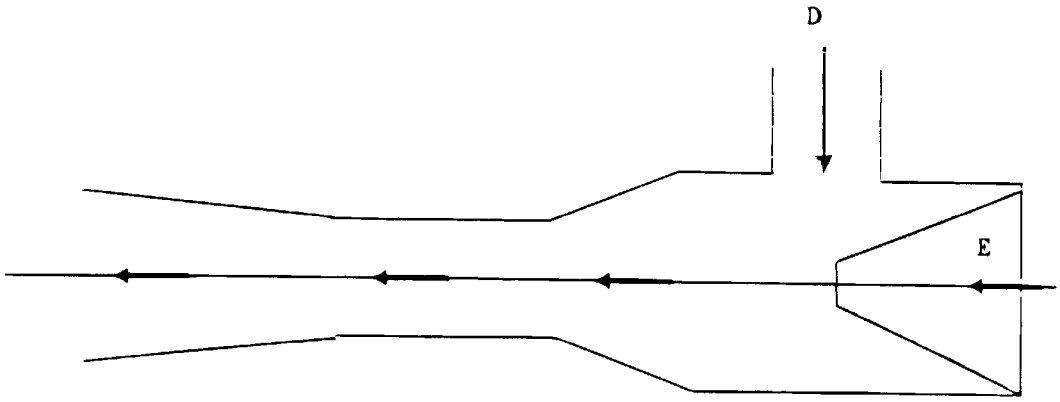
FIGURE 3 PRIOR ART
Figure 4:
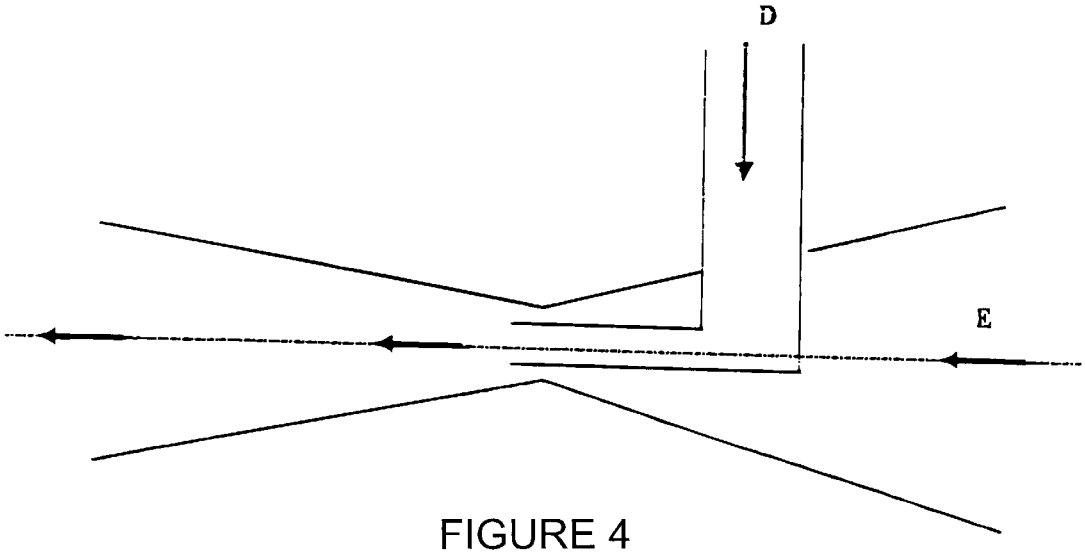
FIGURE 4 PRIOR ART
Figure 5:
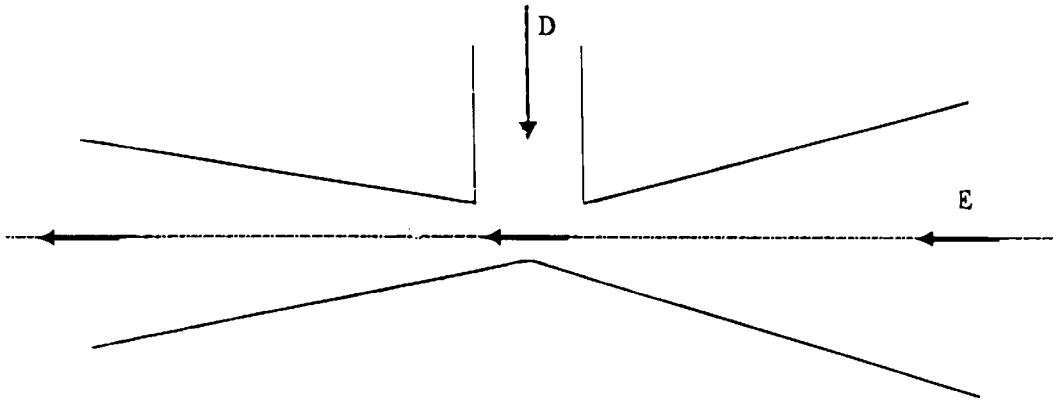
FIGURE 5 PRIOR ART

FIG. 2*a* is a view similar to FIG. 2 using a discharge pump;

FIG. 3, is a schematic view of the jet pump, type-ejector 1;

FIG. 4, is a schematic view of the jet pump, type-ejector 2;

FIG. 5, is a schematic view of the jet pump, type-venturi.

The reference numerals of the components in the drawings are as follows;

1. Jet pump
1*a*. Jet nozzle
2. Inlet hose
3. Outlet hose
4. O-ring
5. Multi-way valve
6. Circulation pump
7. Pump reservoir
8. Clamp
9. Air intake
10. Discharge pump D. Jet pump air intake direction
E. Jet pump water flow direction Improvement of drying performance is provided by circulating the water in the machine through a jet pump preferably by the aid of one of the pumps in the machine (circulation and discharge pumps). Water inside the machine accelerates due to the kinetic energy acquired during the said circulation and reduces the pressure locally to a value below the atmospheric pressure. Due to this reduced pressure value, the vapour and air is removed from the wash tub (FIG. 2). The jet pump (1) is placed so that the air intake (9), will be opened to one of the dishwasher wash tub surfaces. During the operations for improving the drying performance, preferably the circulating pump (6) (FIG. 2) or the discharge pump (10) (FIG. 2*a*) may be used, or it may be driven by a third pump (one or more pumps).

When the circulating pump is used, water circulation is stopped after the last rinsing step in the wash cycle of the dish washer. Then the multiway valve (5) is activated. Under normal operational conditions, the outflow of water being the primary fluid in the valve, is towards the outlet (A). This outlet represents the water circulation system of the dishwasher. The multiway valve activated by a signal, opens the outlet (B) and closes the outlet (A). The circulating pump (6) is driven and as the flow is towards the B outlet, the primary fluid is directed towards the pump (1). Thus, the machine starts to operate for drying (FIG. 2).

When the discharge pump is used, the A outlet of the said multiway valve represents the outlet hose.

Water contained in the pump reservoir (7) is sent to the jet pump (1) through the inlet hose (2) over the multiway valve (5), by means of the pump/motor group (6). Here, water accelerates as its kinetic energy increases. This acceleration in the flow of water creates a pressure in the jet pump (1) which is lower than the pressure within the body. Water vapour and hot air in the body move towards the jet pump (1) due to the difference between the pressures, by means of the air intake (9) one side of which is connected to the jet pump (1) and the other, to a vent on the body. The mixed air composed of vapour and air, represent the secondary fluid and is sucked from the body due to the reduced pressure created by the primary fluid, which is water. The water and air mixture passing through the jet pump (1) then returns to the pump reservoir (7) by the outlet hose (3).

During the drying phase, the jet pump (1) can be operated by using all of the water remained after the last rinsing, or by using the remaining water after the evacuation of some of the water in the wash tub, as the primary fluid, or by using the water taken in after the evacuation of all of the last rinsing water, as primary fluid.

The reservoir required for the primary fluid, namely water that is circulated over the jet pump (1), may be the pump reservoir (7) or a separate water container placed in the machine. Water used in one wash cycle before the last rinsing cycle and kept in the said water container can also be used to actuate the jet pump (1).

Figure 1:
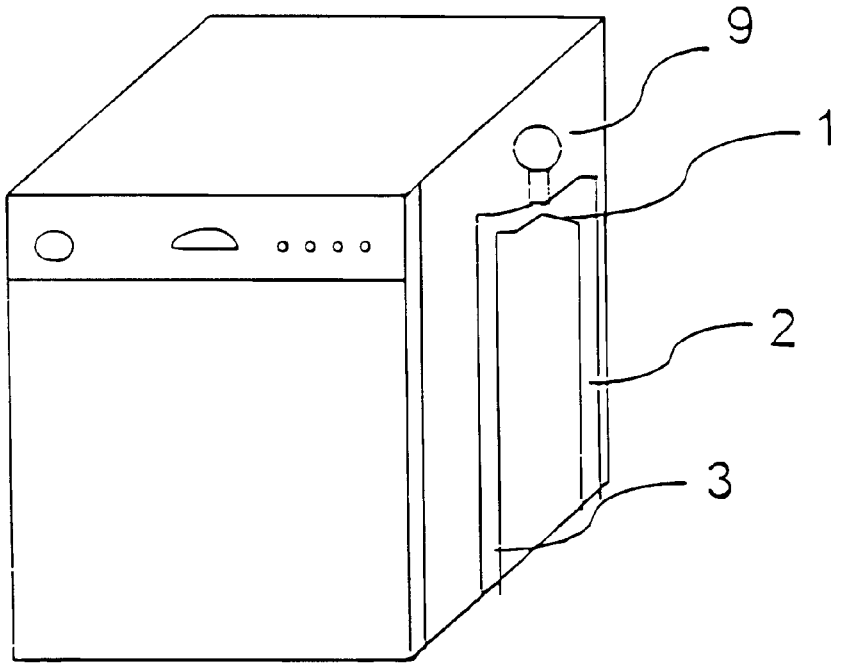
FIG. 1, is a schematic view of a dishwasher wherein the jet pump air intake is placed at one of the side walls of the wash tub.

The air intake (9) that provides the suction of vapour and hot air in the dishwasher body by the help of the jet pump (1) and that provides the connection on the body, can be placed at different points (on one of the side walls of the wash tub, on its rear wall, on its upper surface, on its bottom surface or on the door of the dish washer) on the washing tub of the dishwasher. In FIG. 1, a dish washer with the air intake (9) of the jet pump placed on one of the side walls of the wash tub is shown schematically.

In the invention where ejector type-2 is used as the jet pump (FIG. 4), any one of the known venturi or ejector type jet pumps may also be used (FIGS. 3 and 5).

What is claimed is:

1. A dishwasher with improved drying performance, comprising:

a dishwasher tub;

a pump reservoir for collecting the washing water;

a jet pump having an air intake in communication with the dishwasher tub for sucking a water vapour and air mixture from the dishwasher tub due to a pressure difference created between the dishwasher tub and the jet pump; and an outlet hose connecting the jet pump and the pump reservoir directly to one another for enabling the washing water to return directly to the pump reservoir.

2. A dishwasher according to claim 1 wherein said jet pump includes a venturi.

3. A dishwasher according to claim 1 wherein the jet pump includes an ejector.

4. A dishwasher according to claim 1 wherein the pump for circulating the washing water is a circulation pump.

5. A dishwasher according to claim 1 wherein the pump for circulating the washing water is a discharge pump.

6. A dishwasher according to claim 1 wherein the jet pump air intake is on one of the side walls of the dishwasher tub.

7. A dishwasher according to claim 1 wherein the jet pump air intake is located on one of surfaces of the dishwasher tub.

8. A dishwasher according to claim 1 wherein said jet pump includes a venturi, the pump for circulating the washing water being a circulation pump.

9. A dishwasher according to claim 8 wherein the jet pump air intake is on one of the side walls of the dishwasher tub.

10. A dishwasher according to claim 8 wherein the jet pump air intake is located on one of surfaces of the dishwasher tub.

11. A dishwasher according to claim 1 wherein the jet pump includes an ejector, the pump for circulating the washing water being a circulation pump.

12. A dishwasher according to claim 11 wherein the jet pump air intake is on one of the side walls of the dishwasher tub.

13. A dishwasher according to claim 11 wherein the jet pump air intake is located on one of surfaces of the dishwasher tub.

14. A dishwasher according to claim 1 wherein said jet pump includes a venturi, the pump for circulating the washing water being a discharge pump.

15. A dishwasher according to claim 14 wherein the jet pump air intake is on one of the side walls of the dishwasher tub.

16. A dishwasher according to claim 14 wherein the jet pump air intake is located on one of surfaces of the dishwasher tub.

17. A dishwasher according to claim 1 wherein the jet pump includes an ejector, the pump for circulating the washing water being a discharge pump.

18. A dishwasher according to claim 17 wherein the jet pump air intake is on one of the side walls of the dishwasher tub.

19. A dishwasher according to claim 17 wherein the jet pump air intake is located on one of surfaces of the dishwasher tub.

* * * * *